US006511242B1

(12) United States Patent
Ferretto

(10) Patent No.: US 6,511,242 B1
(45) Date of Patent: Jan. 28, 2003

(54) GUN FOR SEALING WITH SEALING WAX

(76) Inventor: Guglielmino Ferretto, Via Furlanetto, 18, Padova (IT), 35100

( * ) Notice: Subject to any disclaimer, the term of this patent is extended or adjusted under 35 U.S.C. 154(b) by 0 days.

(21) Appl. No.: 09/563,361

(22) Filed: May 3, 2000

(30) Foreign Application Priority Data

May 7, 1999 (IT) ..... PD99A0097

(51) Int. Cl.[7] ..... A46B 11/08

(52) U.S. Cl. ..... 401/1; 401/176; 118/100; 118/120

(58) Field of Search ..... 401/1, 2, 171, 401/176, 178, 179; 239/133, 239, 375, 376, 378; 222/146.5; 156/244.16, 244.11; 118/46, 75, 100, 120, 125

(56) References Cited

U.S. PATENT DOCUMENTS 4,065,214 A * 12/1977 Daum et al. ..... 401/1
5,154,522 A * 10/1992 Nobilec ..... 401/1
5,980,144 A * 11/1999 DeBourg et al. ..... 401/1

* cited by examiner

*Primary Examiner*—David J. Walczak
(74) *Attorney, Agent, or Firm*—Dowell & Dowell, P.C.

(57) ABSTRACT

A gun for sealing with sealing wax which includes a handgrip, a tank melting-pot for the sealing wax, a feeding device, an injector, and a punch. The gun is heated by heating elements. The tank melting-pot is connected with the feeding device and with the injector which consists of a chamber provided, in its terminal part, with a nozzle in which a plunger slides. The punch consists of a sliding rod provided, in its end, with a metallic engraved or raised mark.

7 Claims, 3 Drawing Sheets

GUN FOR SEALING WITH SEALING WAX

BACKGROUND OF THE INVENTION

1. Field of the Invention

The present invention relates to the field of safety and particularly concerns antitampering seals and tooling for their application.

2. Description of the Related Art

Often, one or more than one safety seals are necessary in order to prevent the tampering of particular elements such as doors, equipment and plants, plugboards, junction boxes, machinery, containers and the like.

To seal meters and plants, a lead seal is generally used which includes a plated metallic wire which is inserted into holes of the parts to be sealed and its ends are inserted in a hole of a lead disk. Thereafter, the lead disk is pressed and strained by special pliers so that the walls of the hole of the lead disk grasp the metallic wire thereby preventing its withdrawal.

The lead seal is efficient if only some holes for the metallic wire are present or can be made on the walls to be sealed. Sealing by sealing wax allows even smooth parts which are without holes or which cannot be drilled to be sealed. As a matter of fact, the sealing wax adheres and conforms to the various parts, penetrates the fissures and becomes attached to the surfaces. Sealing by sealing wax is, therefore, functional but has some drawbacks.

It is necessary to melt the right quantity of sealing wax on walls to be sealed using a free flame or another heat source. In case of vertical or very sloping surfaces, it is hard to melt and dispense the sealing wax. When the melted sealing wax has started to harden, but is still malleable, it is punched by means of a metallic mark.

Until now, to apply a seal of sealing wax, the following articles are necessary; a sealing wax stick, a flame, a knife for removing the possible burr, and a punch to mark the applied sealing wax. Moreover, each step of this process implies a considerable manual skill, ability and it takes time.

SUMMARY OF THE INVENTION

In order to eliminate the above cited drawbacks, a new sealing gun has been designed and carried out which can automatically seal, by means of sealing wax, every kind of surface. The new gun maintains the sealing wax liquid, measures out a specific quantity of sealing wax and then sprays the sealing wax on the parts to be sealed and punches the wax with a mark. The new sealing gun includes a handgrip, a tank-melting-pot for the sealing wax, a feeding device, an injector, and a punch. All the various parts are mounted on the handgrip so as to make use of the new sealing gun comfortable.

BRIEF DESCRIPTION OF THE DRAWINGS

The new sealing gun is described as follows making reference to the accompanying drawings, wherein.

DESCRIPTION OF THE PREFERRED EMBODIMENT

Figure 1:
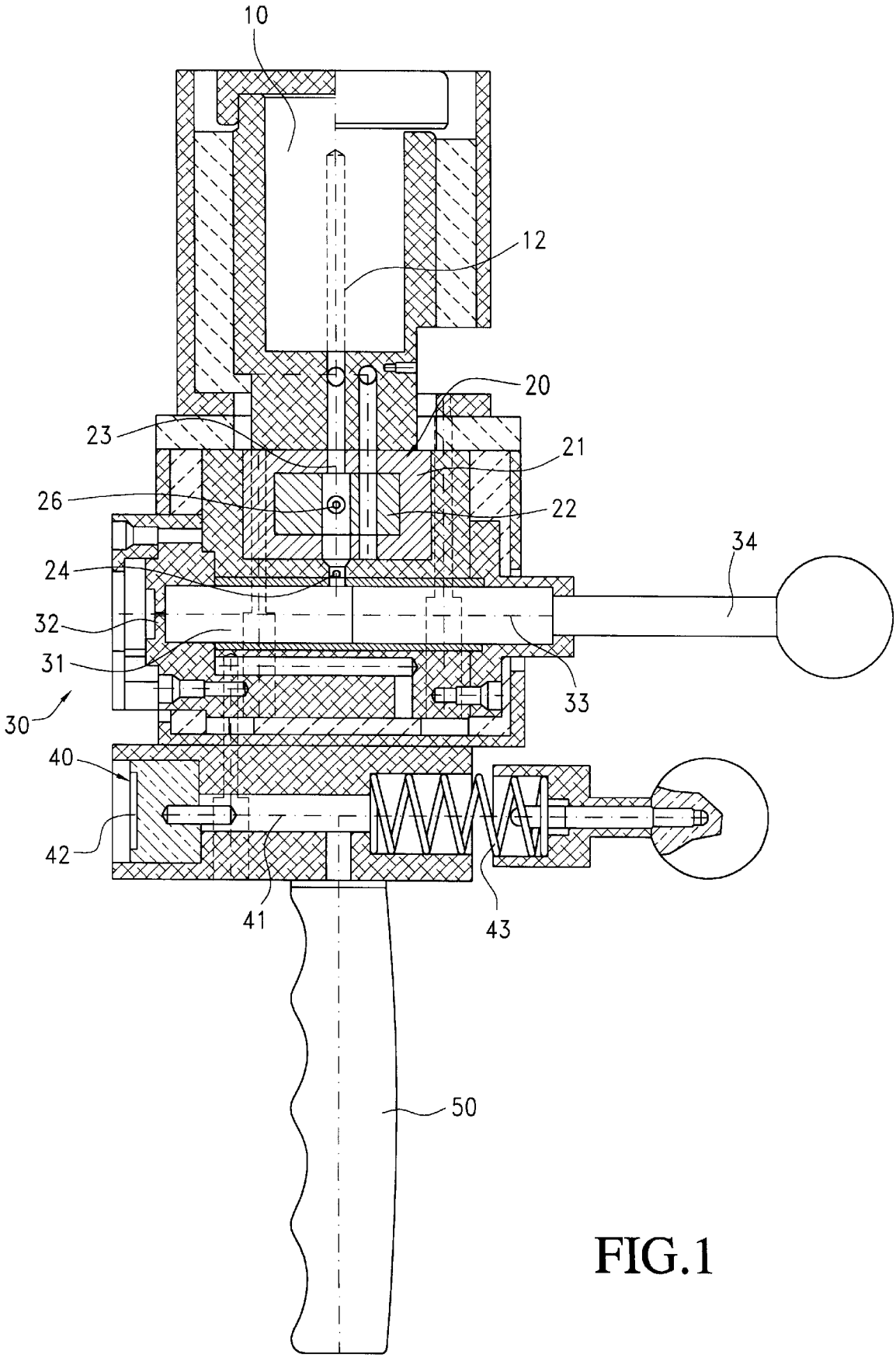
FIG. 1 is a cross sectional view of the sealing gun of the present invention.
Figure 2:
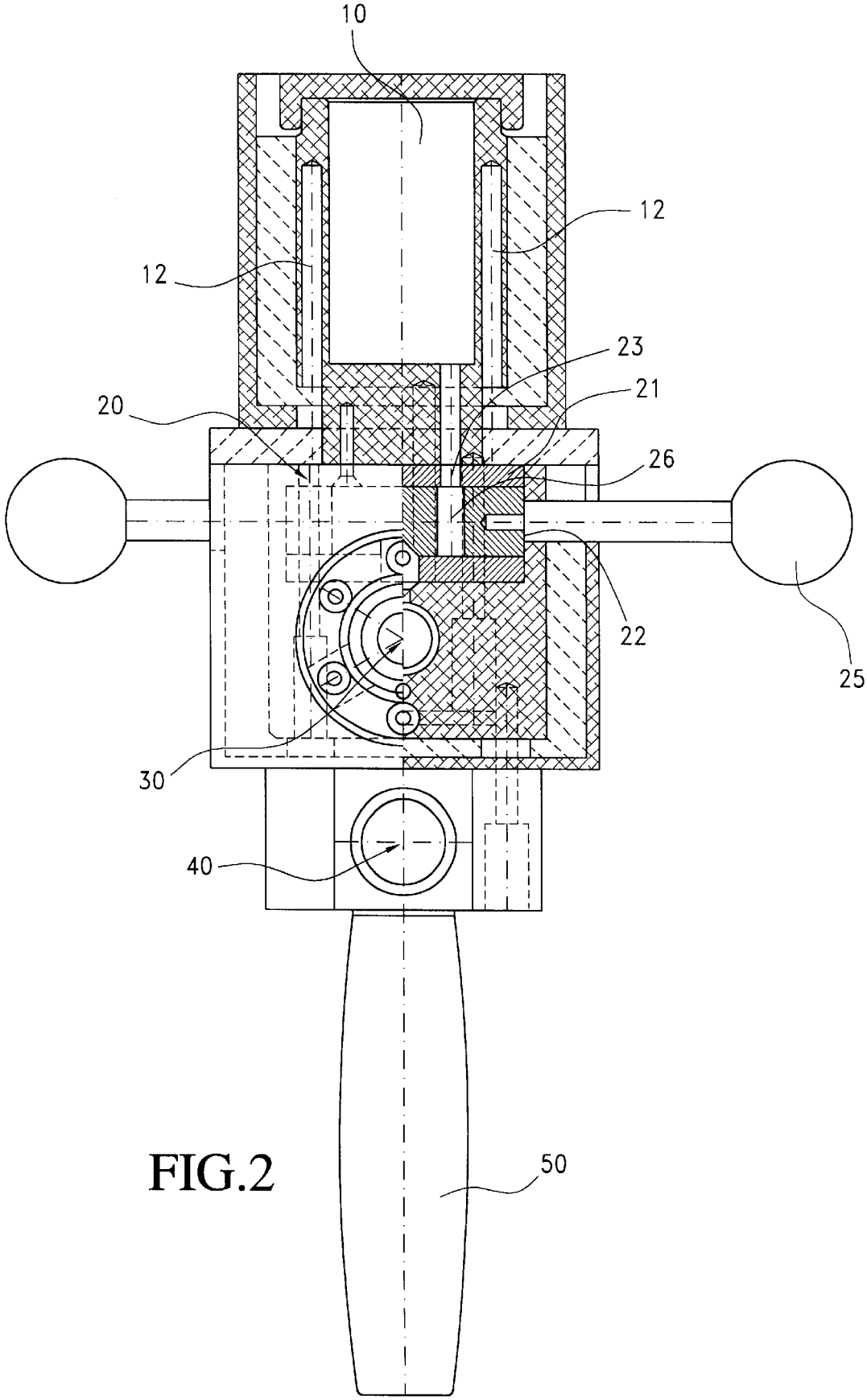
FIG. 2 is a cross sectional view taken along a plane perpendicular to the plane of the view of FIG. 1.

A tank 10 contains a sealing wax to be applied and is provided with two heating elements 12 which heat both the tank, maintaining the sealing wax liquid, and the various parts of the sealing gun involved in the passage of the liquid sealing wax. The tank is connected at its lower side to a feeding device 20 in which the sealing wax flows.

The feeding device consists of a chamber 21 with a sliding piston 22 which is externally controlled. The chamber is provided, in its upper part, with a hole 23 positioned near one of its ends which connects the chamber with the tank melting-pot 10. The chamber is also provided, at its other end, with a lower hole 24 which connects the chamber with an injector assembly 30.

The sliding piston 22 positioned inside the chamber 21 of the feeding device 20 is provided with an inner hollow chamber 26 with two openings, an upper and lower one. The volume of the inner hollow chamber 26 of the piston 22 is able to contain the right quantity of sealing wax necessary for the sealing. The piston is controlled by an external lever 25.

The dimensions of the piston 22 and the position of its openings are such that the piston, in its alternative stroke, has its upper opening in alignment with the opening 23 of the chamber 21 and thus towards the tank-melting pot 10 for receiving the sealing wax. The piston, when translated towards an opposite end, has its lower opening in alignment with the lower opening 24 of the chamber 20 of the feeding device.

When the piston is translated by means of an appropriate lever 25, the lower opening of the piston 22 is aligned with the opening towards the injector 30 and the sealing wax contained in the chamber 26 of the piston flows into the injector.

The injector 30 includes a chamber 31 in which the necessary quantity of sealing wax is received, a terminal part provided with a nozzle 32 and with a plunger controlled by an appropriate lever 34.

A punch 40 consists of a sliding rod 41, positioned slightly over a handgrip 50, is provided with a metallic mark 42 in one end and by a return spring 43 on the other end.

The metallic mark 42 is provided with some drawings or initials engraved or raised on the opposite side of the rod 41.

For creating a seal with sealing wax by use of the new gun, it is necessary to melt the sealing wax contained in the tank-melting pot, to work the feeding device 20 so as to convey a specific quantity of sealing wax to the injector 30, to rest or bring close the nozzle 32 of the injector to the point at which the sealing wax is to be applied, and to thereafter activate the plunger 33 of the injector. In this way, a specific quantity of sealing wax is precisely sprayed on the surfaces. Immediately after, the gun is translated, by means of manual or automatic positioning systems, and as soon as the sprayed sealing wax starts to solidify, the gun is brought near the sealing wax with the punch 40 in-line with the sealing wax, and the punch 40 is activated. The metallic mark 42 deforms the sealing wax according to the engraved or raised surface, thereby obtaining a final seal.

Alternatively, it is possible to provide for the lever to activate both the plunger and the punch wherein the external part of the punch is provided with a mark which can be brought into contact with a surface to be sealed.

Figure 3:
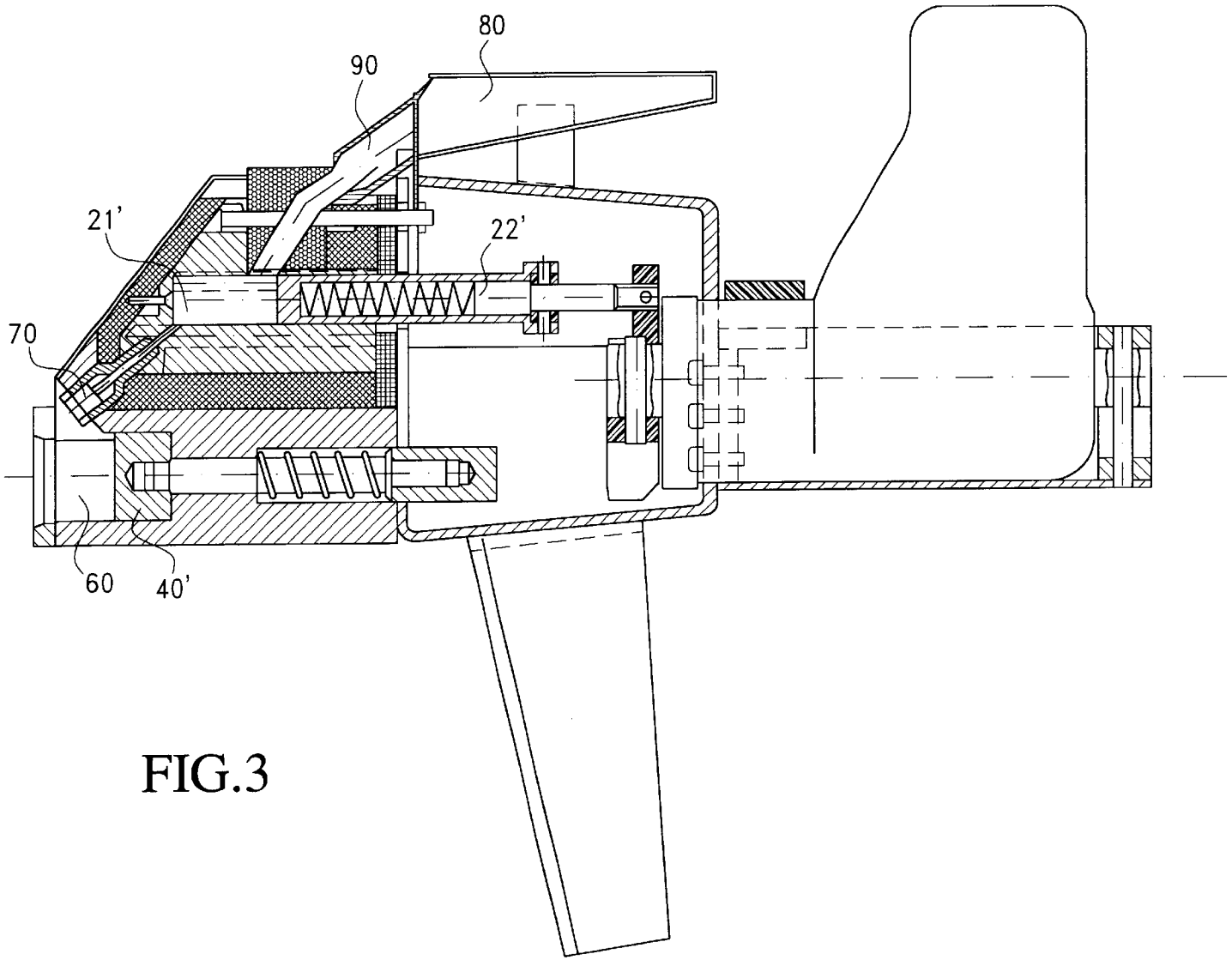
FIG. 3 is a cross sectional view of a varied embodiment of the invention taken in the plane of the view of FIG. 2.

As an alternative to the manual operation of the plungers or levers, it is possible to move these elements by means of motors or actuators which are activated in the right sequence. As shown in FIG. 3, in this way, sealing wax at solid state, which is put into the chamber 80 through a duct 90 enters, at a variable volume, into a chamber 21' of an injector in which it is heated by the heating elements until melting. The piston 22' compresses the fluid wax which flows downward through the duct 70 which defines a nozzle into the compartment 60 in front of the punch 40'.

The volume of the chamber 21' is varied depending upon the positioning of the piston 22' relative to the duct 90.

Therefore, with reference to the above description and the enclosed drawing, the following claims are put forth.

What is claimed is:

1. A gun for applying a wax seal, the gun comprising; a tank melting-pot for retaining a sealing wax, heating elements mounted within the gun for heating the sealing wax within said tank melting-pot, said tank melting-pot being in flow communication with a feeding device which includes a piston with a hollow chamber, said hollow chamber of said piston being selectively movable into fluid communication with said tank melting-pot and with an injector at opposite ends of a stroke of said piston, said injector including a second chamber and a nozzle, a plunger slideably mounted in said second chamber so as to direct wax within said second chamber through said nozzle, and a punch including a sliding rod having a marked end and wherein said heating elements maintain the wax in a liquid state as the wax passes from said tank melting-pot and through said feeding device and said injector.

2. The gun for applying a wax seal of claim 1 including a return spring for normally urging said punch within the gun.

3. The gun for applying a wax seal of claim 1 including a first lever for manually moving said piston and a second lever for manually moving said punch.

4. The gun for applying a wax seal of claim 1 wherein said hollow chamber of said piston includes a first opening which aligns to receive liquid wax from said tank melting-pot when said piston is in a first position and a second opening which aligns to feed liquid wax to said injector when said piston in a second position.

5. A gun for applying a wax seal, the gun comprising a tank melting-pot for retaining a sealing wax, a heating element for heating the sealing wax in said tank melting-pot, a feeding device for conveying liquid wax from said tank melting-pot to an injector, said feeding device including a variable volume chamber in which a piston slides from and towards a nozzle of said injector, a punch including a sliding rod having a metallic mark in its end, said nozzle being disposed to dispense the liquid wax into an area proximate to said punch, and wherein said heating elements maintain the sealing wax liquid within said feeding device and said injector.

6. The gun for applying a wax seal of claim 5 including a return spring for normally urging said punch within the gun.

7. The gun for applying a wax seal of claim 5 including a first lever for moving said piston and a second lever for moving said punch.

* * * * *